US006736471B2

(12) United States Patent
Lin

(10) Patent No.: US 6,736,471 B2
(45) Date of Patent: May 18, 2004

(54) BUFFER AND RETURN DEVICE FOR A SLIDE RAIL IN A DRAWER

(75) Inventor: Chun-Wei Lin, Taipei Hsien (TW)

(73) Assignee: Nan Juen International Co., Ltd., Taipei Hsien (TW)

( * ) Notice: Subject to any disclaimer, the term of this patent is extended or adjusted under 35 U.S.C. 154(b) by 0 days.

(21) Appl. No.: 10/230,993

(22) Filed: Aug. 30, 2002

(65) Prior Publication Data

US 2003/0234604 A1 Dec. 25, 2003

(30) Foreign Application Priority Data

Jun. 20, 2002 (TW) ..... 91209230 A

(51) Int. Cl.[7] ..... A47B 88/04
(52) U.S. Cl. ..... 312/333; 312/334.6
(58) Field of Search ..... 312/333, 330.1, 312/334.1, 334.6, 334.44, 319.1, 319.2; 16/84, 49, 66; 248/636, 565

(56) References Cited

U.S. PATENT DOCUMENTS 5,207,781 A * 5/1993 Rock ..... 312/319.1
5,364,179 A * 11/1994 Brustle et al. ..... 312/333
2002/0066629 A1 * 6/2002 Muller ..... 188/380

FOREIGN PATENT DOCUMENTS

DE 2421657 * 11/1975 ..... 312/334.44

* cited by examiner

*Primary Examiner*—James O. Hansen
(74) *Attorney, Agent, or Firm*—Troxell Law Office PLLC

(57) ABSTRACT

A buffer and return device for a slide rail in a drawer attached to an outer rail of the drawer and includes a base, a buffer plunger and an elastic element. The base has a base chamber at a front section thereof. The base chamber has an air passage, a lateral passageway at another section thereof and a bend bottom slot. The buffer plunger has a size corresponding to the base chamber. The elastic element has an end thereof fixed to a front end of the base chamber. The retaining plate has a holding way for a lock piece of an inner rail in the slide rail moveable between a locked and released positions and is connected with the buffer plunger and the elastic element with a lower projection at a bottom thereof for passing through the bottom slot. Once the drawer is pulled outward and then pushed inward, the buffer plunger squeezes the air in the base chamber to forceably discharge via the air passage so as to slowly return the drawer to an initial position.

7 Claims, 9 Drawing Sheets

BUFFER AND RETURN DEVICE FOR A SLIDE RAIL IN A DRAWER

BACKGROUND OF THE INVENTION

1. Field of the Invention

The present invention relates to a buffer and return device for a slide rail in a drawer, and particularly to a buffer and return device where the drawer with the inner rail thereof returns to the original position slowly when the drawer is pushed inward.

2. Description of Related Art:

The application of a slide rail is frequently seen and used in our daily life. For instance, a drawer can be pulled outward to extend the length thereof and can be pushed back to restore the original length thereof so that it is possible for the sliding drawer to save more space than a hinge type application. In addition, the sliding door is also an application of slide rail.

The slide rail, especially the slide rail used in a drawer, is capable of reducing the manual force required to push the drawer inward and to pull it outward. Hence, there are various return devices designed and developed such that the drawer can be slid along the slide rail to reach a locked state before the drawer reaches the end of the stroke thereof. In fact, excessive slide speed or excessive pushing may result in impact, noise and damage of the drawer so it is a subject of interest to move the drawer back to the initial position thereof while providing a buffering function.

SUMMARY OF THE INVENTION

The crux of the present invention is to provide a buffer and return device for a slide rail in a drawer that can be attached to an outer rail of the drawer and includes a base, a buffer plunger and an elastic element. The base has a base chamber at a front section thereof. The base chamber has an air passage, a lateral passageway at another section thereof and a bend bottom slot. The buffer plunger has a size thereof corresponding to the base chamber. The elastic element has an end thereof fixed to a front end fo the base chamber. The retaining plate has a holding way for a lock piece for an inner rail in the slide rail moveable between a locked or released position and is connected with the buffer plunger and the elastic element by a lower projection at a bottom thereof for passing through the bottom slot. Once the drawer is pulled outward and then pushed inward, the buffer plunger squeezes the air in the base chamber to discharge via the air passage forcedly to slowly return the drawer to an initial position.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
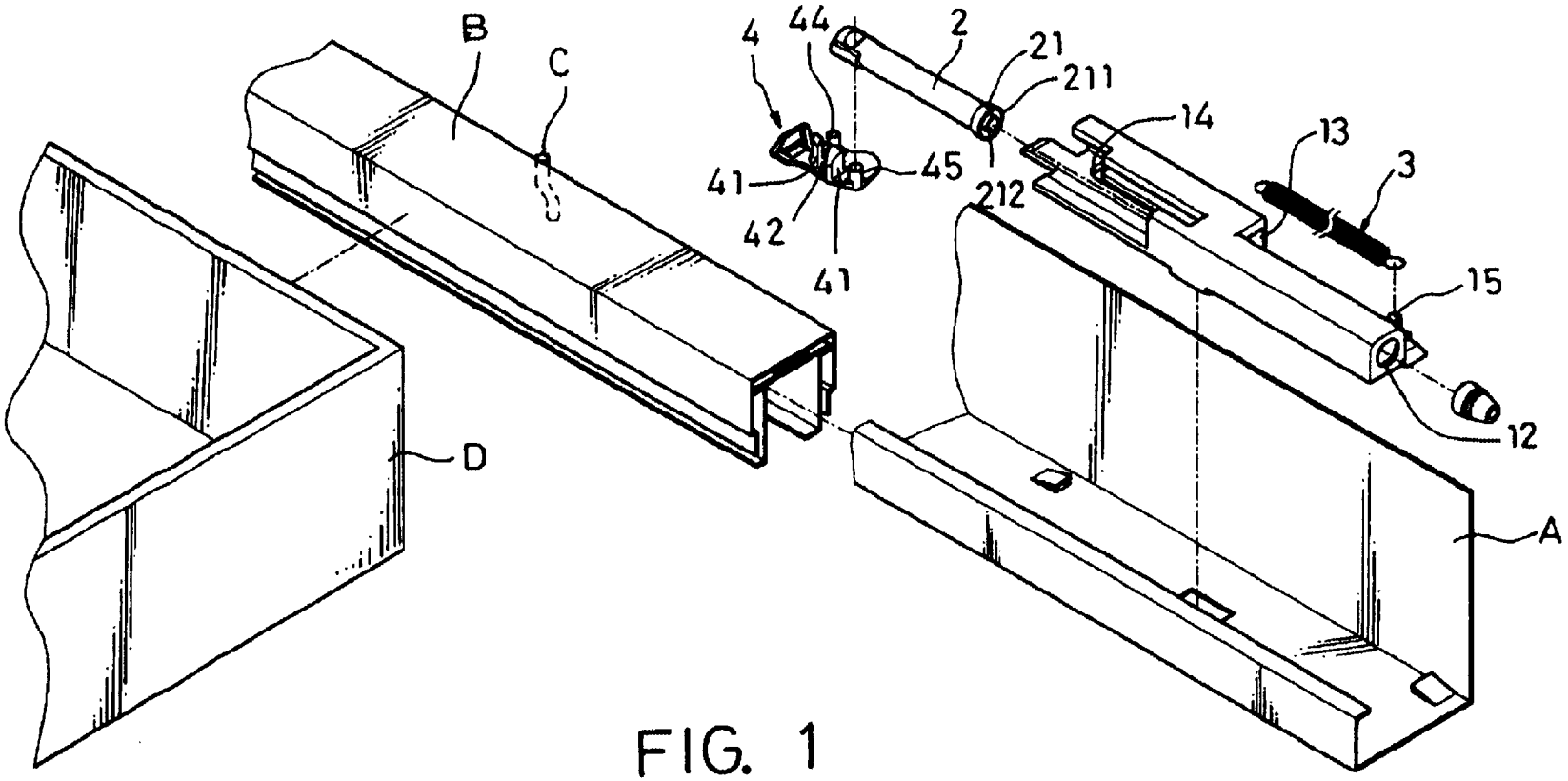
FIG. 1 is a perspective exploded view of a buffer and return device for a slide rail in a drawer according to the present invention.

Referring to FIG. 1, a buffer and return device of the present invention is disposed in an outer rail A, which is slid along an inner rail B, and the buffering return device includes a base 1, a buffer plunger 2, an elastic element 3 and a retaining plate 4.

Wherein, the base 1 is fixedly attached to the outer rail A at a front end thereof, i.e., an inner end thereof close to the bottom of the drawer, having an enclosed base chamber 11. In order to be available for ventilating, an air passage 12 is provided in the base 1 and the air passage 12 can be formed with an air hole arranged at the most front end of the base 1 or a blind groove at the inner wall of the base 1. A purpose of the air passage 12 is to exhaust the air in the base chamber 11 slowly when the buffer plunger 2 is pressed forward such that the buffer plunger 2 moves at a slow speed due to the air resistance. Hence, the air passage 12 relates to the movement of air between the buffer plunger 2 and the base chamber 11, which can be arranged in various ways.

The base 1, at a lateral side of another section thereof, may be provided with a hollow passage 13 receiving an elastic element 3. In fact, it is not necessary to provide the hollow passage 13 if the elastic element 3 stretches and recoils correctly. The hollow passage 13 at the bottom thereof can be provided with a lower bend slot 14 to guide the elastic element 3 when stretched and the base 1 at the front end thereof, i.e., on the base 1 or on the outer rail A, may have an engaging jut 15 for fixing an end of the elastic element 3.

The plunger 2 is elongated preferably with a cylindrical shape but not essentially and preferably is made of elastic material. One end of the plunger 2 forms an airtight seal with the base chamber 11. A plunger head 21 with a larger diameter can be arranged as the airtight end. The plunger head can be formed of an annular plunger ring 211 and a central plunger core 212 not joined to the plunger ring 211 such that the plunger ring 211 is thinner in the thickness thereof so as to be capable of being deformed. A rear end of the plunger head is provided with a joining part 22 for connecting with the retaining plate 4 and the connecting part disclosed in the embodiment is a through hole. Of course, any other type of connector such as a hook piece can be utilized.

The elastic element 3 is made of stretchable material such as a spring disclosed in the embodiment. The spring is only an example not to limit the use of the elastic element 3. The spring is connected at a first end to the engaging jut 15 and at a second end to the retaining plate 4 so that the elastic element 3 can stretch or coil back when the retaining plate 4 moves outward or inward.

The retaining plate 4 engages a lock piece C in the inner rail firmly such that two protruding catches 41 with a holding way 42 therebetween are provided on the retaining plate 4 to locate the lock piece C in the holding way 42. The retaining plate 4 shown is only an example and any other equivalent mode can be used instead. The bottom of the retaining plate 4 has a lower projection 43 (not shown due to the projecting angle) with a size thereof corresponding to the lower slot 14 such that the lower projection 43 can slide along the lower slot 14 and is positioned at the bend corner of the lower slot 14. The retaining plate also provides an engaging post 44 to connect to an end of the elastic element 3 and a connecting piece 45 for connecting with the plunger 2.

Figure 2:
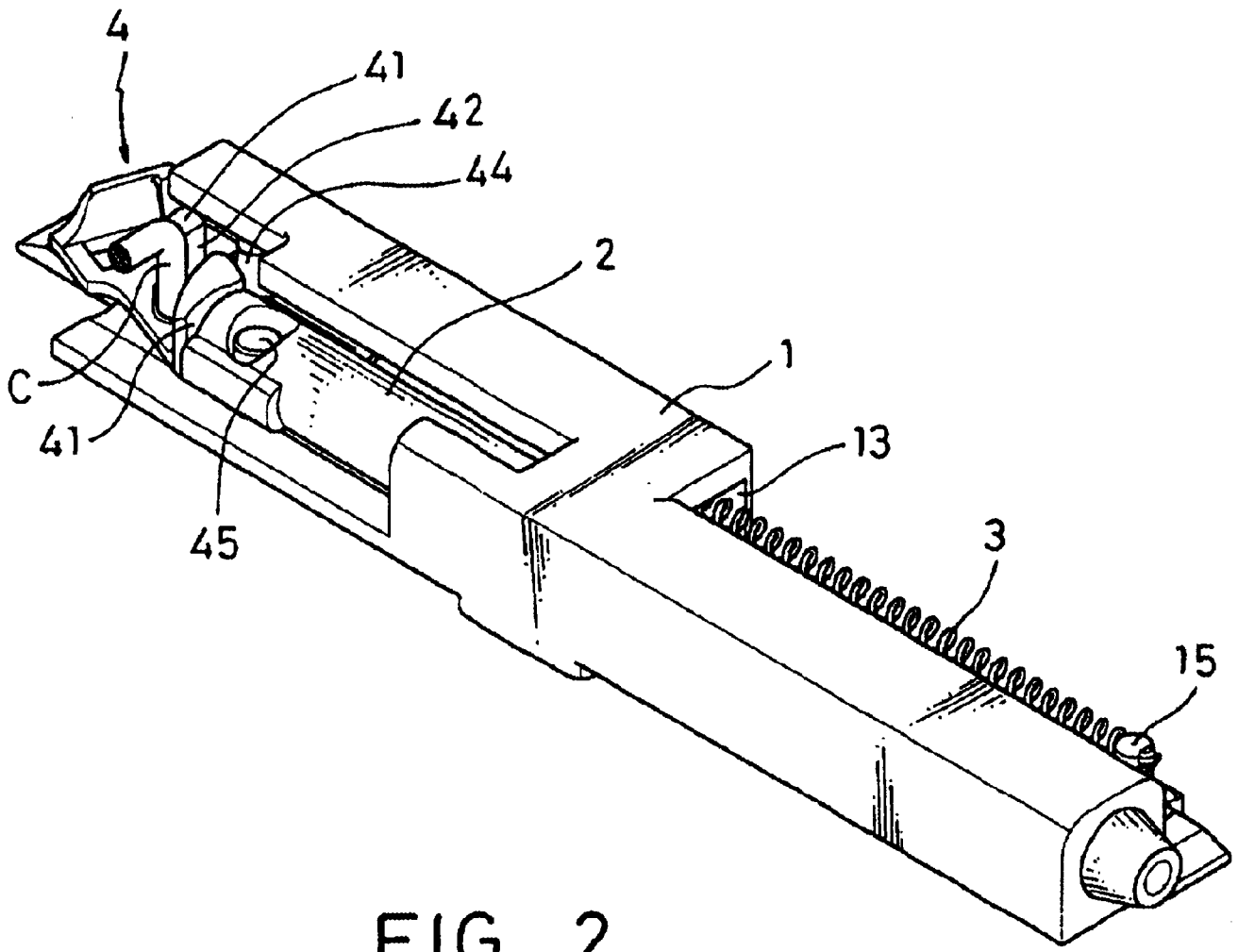
FIG. 2 is an assembled perspective view of the buffer and return device shown in FIG. 1.

Referring to FIG. 2, the assembled buffering return device of the present invention is shown in FIG. 2. When a drawer D is arranged in the inner rail B, the elastic element 3 is stretched as the retaining plate 4 moves outward with the buffer plunger 2 and the retaining plate 4 moves with the lock piece C.

Figure 3:
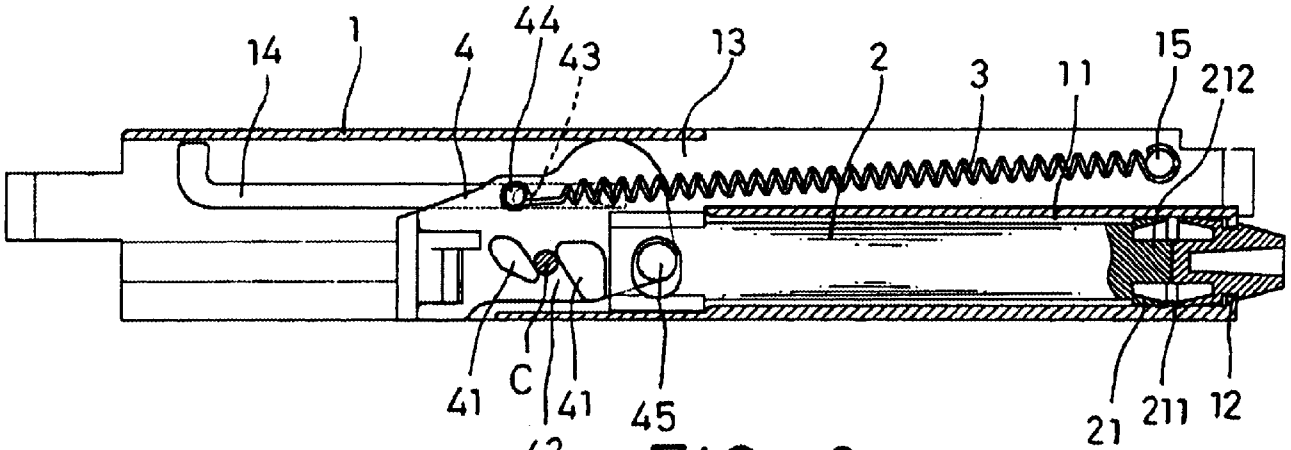
FIG. 3 is a sectional view of the buffer and return device before the drawer being pulled outward.

Referring to FIG. 3 is company with FIGS. 1 and 2, the buffering return device of the present invention is positioned on the outer rail A with the rear end thereof, i.e., the pulled end thereof, being provided with a stopper. The lock piece C and the drawer are connected to the inner rail B respectively. FIG. 3 shows the buffering return device in a position prior to being pulled outward. The lock piece C falls in the holding way 42 and the elastic element 3 is in an unstretched position.

Figure 4:
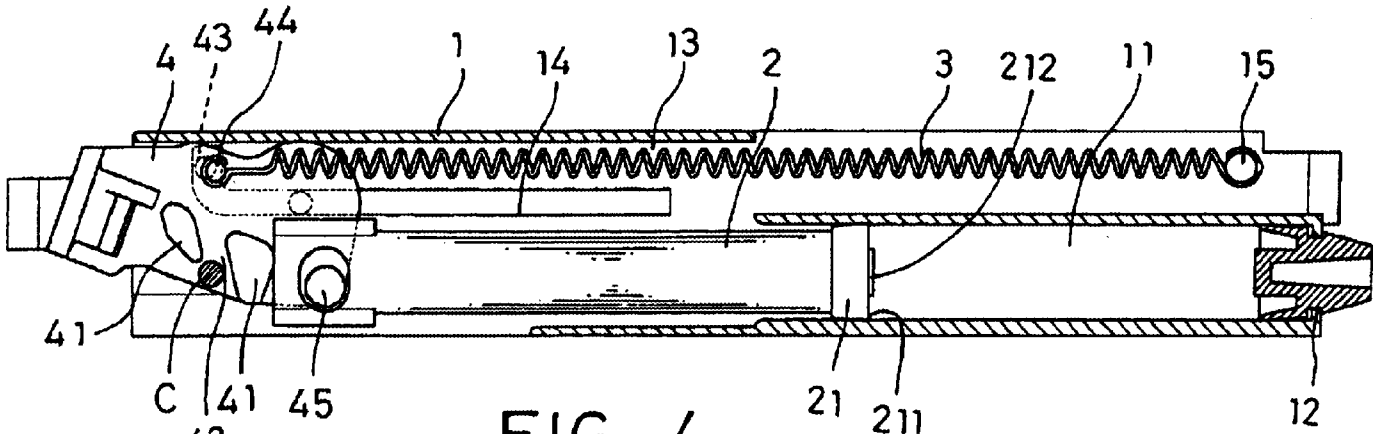
FIG. 4 is a sectional view of the buffer and return device after the drawer being pulled outward.

Referring to FIG. 4, the elastic element 3 is stretched as the drawer is pulled outward with the inner rail B and the lower projection 43 falls into the bend corner of the bottom slot 14 to constitute a position lock. If the drawer is pulled outward further, the retaining plate 4 turns to the lock piece C and is apart from the holding way 42 such that the retaining plate is free to move outward continuously.

When the drawer is pushed inwardly, the retaining plate 4 returns and the lower projection 43 moves to a flat spot away from the bend corner of the bottom slot 14. At this time, the elastic element contracts at a slower speed due to the buffer plunger 2 and the base chamber 11 being airtight with each other and the air therein only discharging through the air passage 12 to reduce the impact. Therefore, the drawer D is slowly moved back to the initial position by the inner wall rail 2 with the lock piece C being positioned in the holding way 42.

Figure 5:
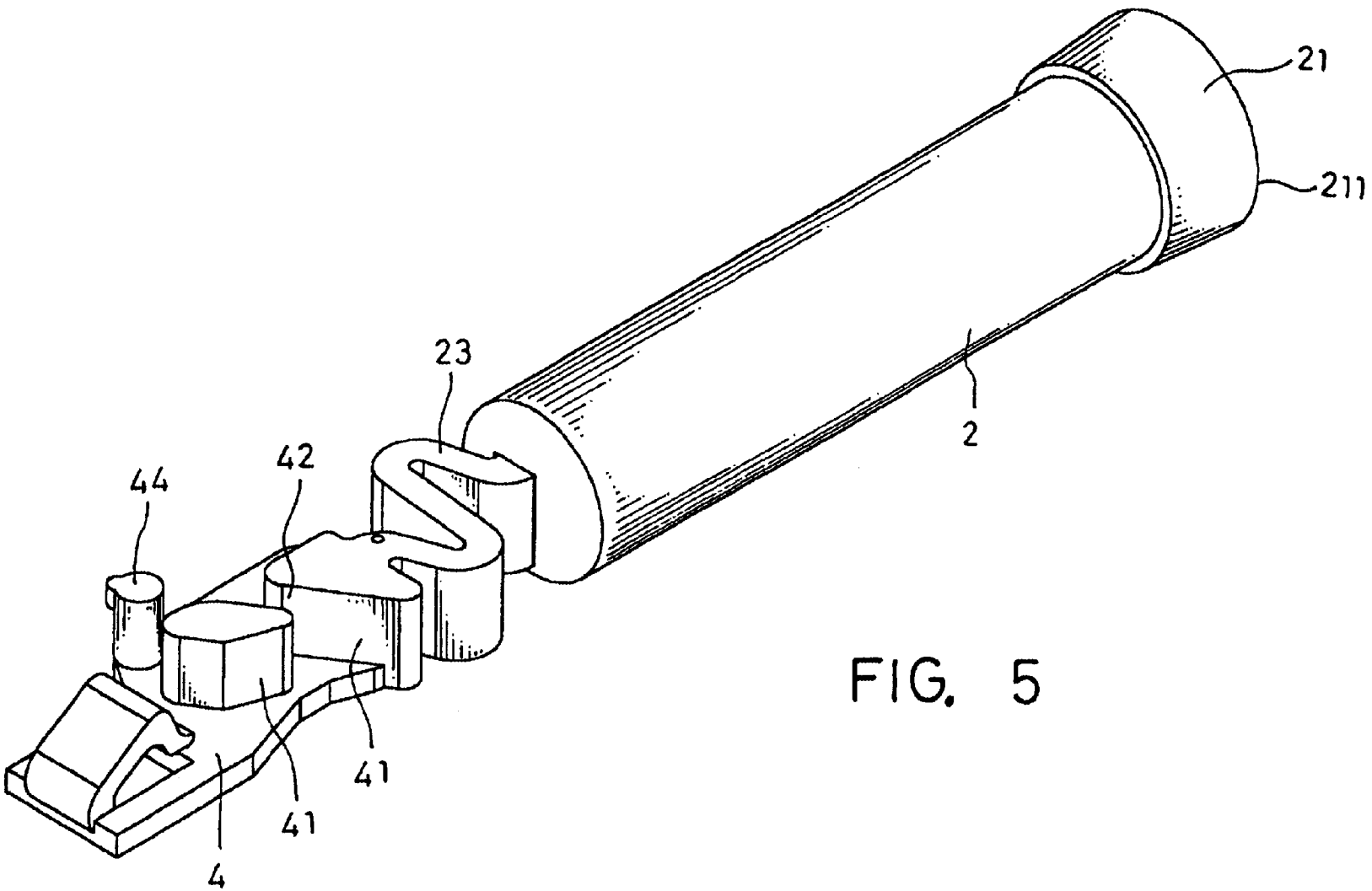
FIG. 5 is a perspective view illustrating a retaining plate being arranged next to a buffer plunger provided in the buffer and return device.

Referring to FIG. 5, the buffer plunger 2 has a curvy connection 23 located between the buffer plunger 2 and the retaining plate 4. Hence, the connecting piece 45 can be deleted from the retaining plate 4.

Figure 6:
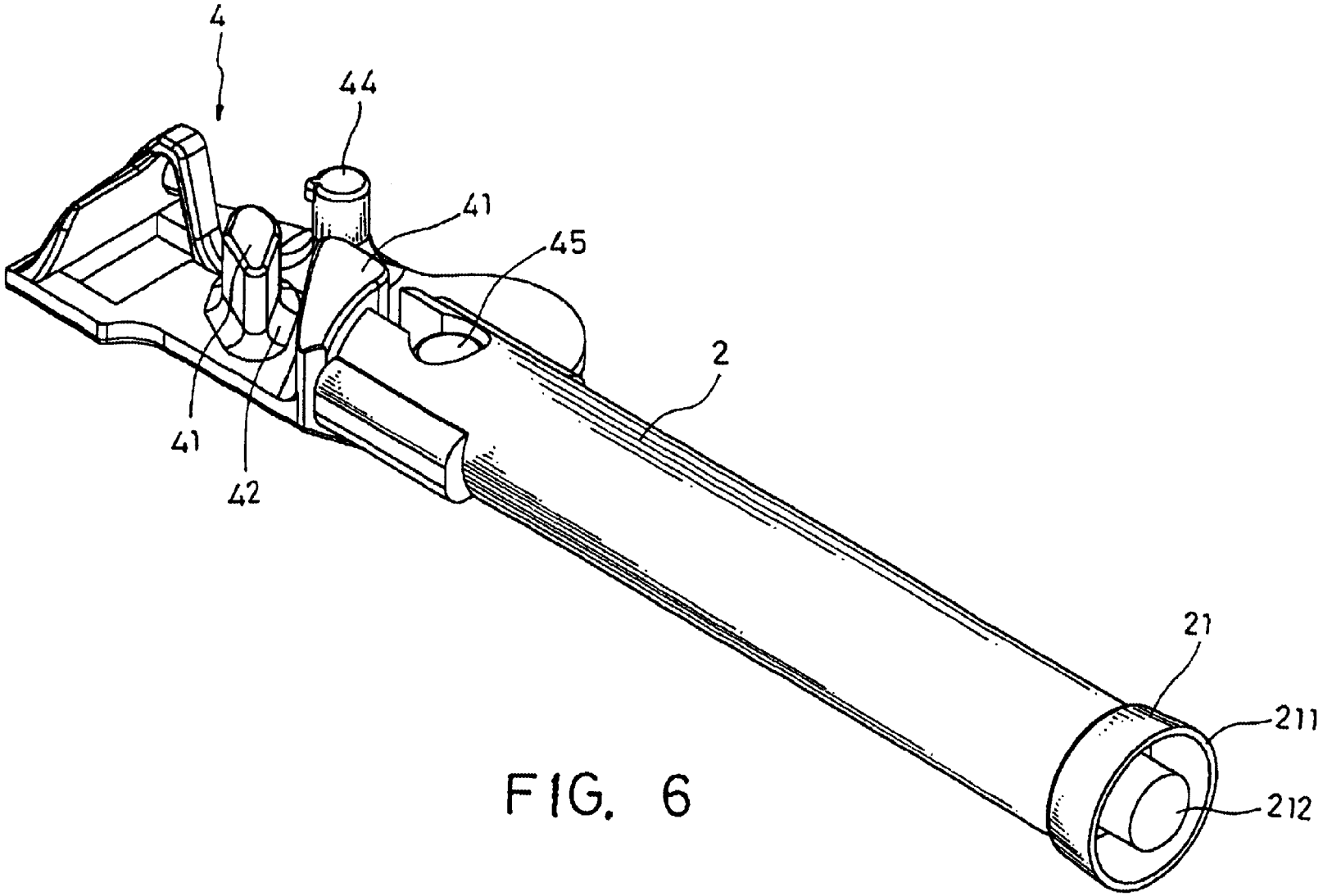
FIG. 6 is a perspective view illustrating the retaining plate engaging with the buffer plunger.

Referring to FIG. 6, the retaining plate 4 can be connected with the buffer plunger 2 by a lock type connector.

Figure 7:
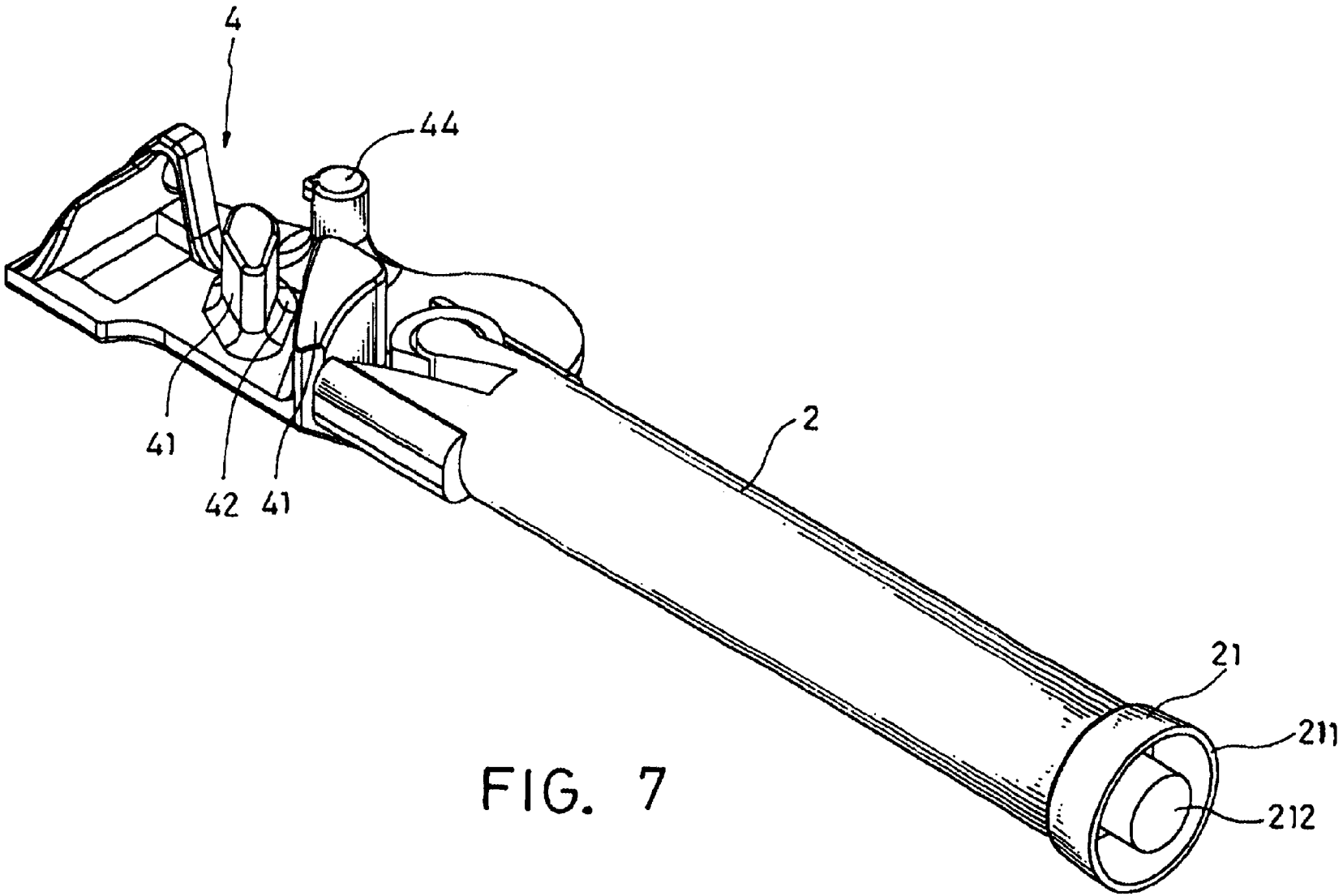
FIG. 7 is a perspective view illustrating another way of the retaining plate engaging with the buffer plunger.

Referring to FIG. 7, another method of joining the retaining plate 4 with the buffer plunger 2 to perform the same function is illustrated.

Figure 8:
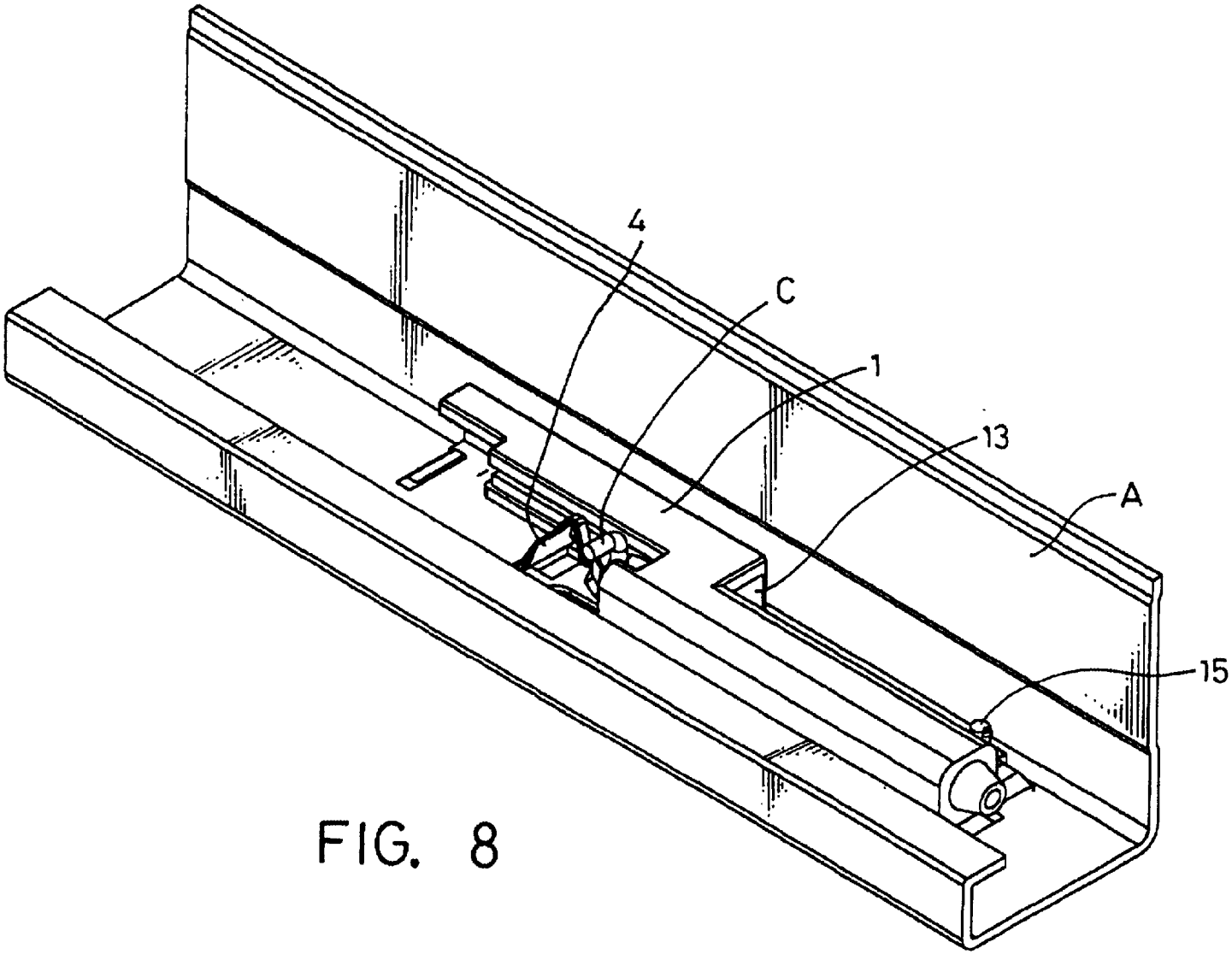
FIG. 8 is a perspective view illustrating a section of base in the buffer and return device being not provided with a lower groove thereof being disposed at an outer rail thereof.

Referring to FIG. 8, the base 1 does not have a bottom part and the outer rail A at the bottom thereof is provided with the bottom slot 14 to carry out the function of the position lock.

Figure 9:
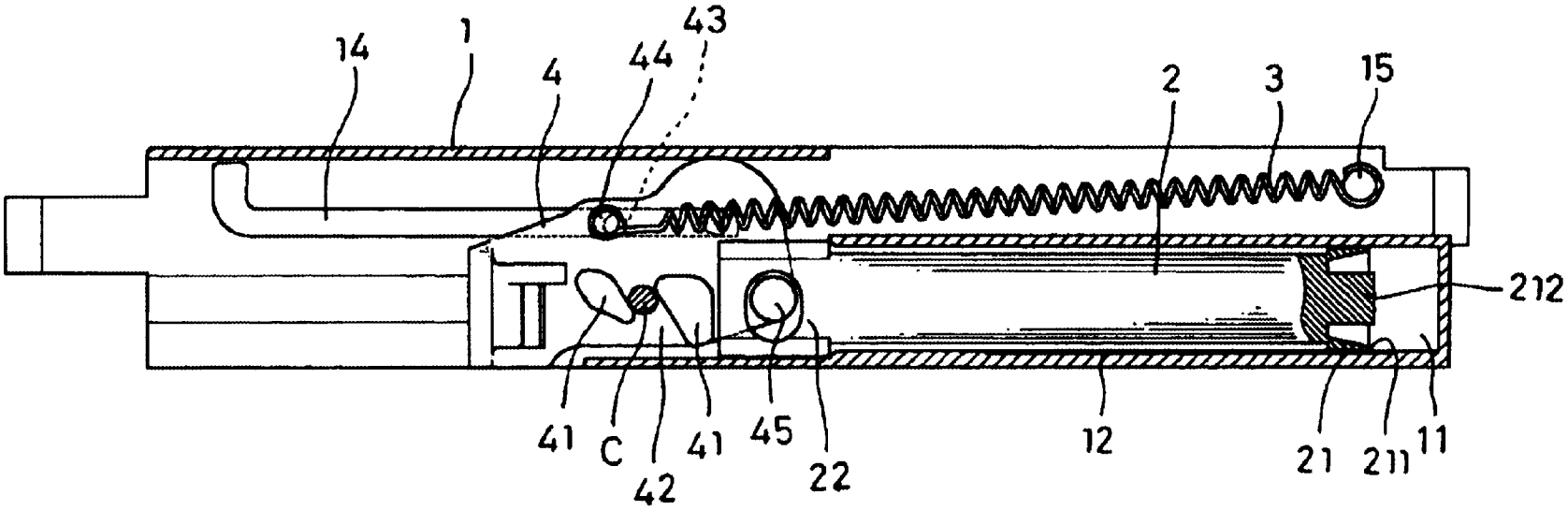
FIG. 9 is a sectional view illustrating an air passage being provided at the inner wall of the base.

Referring to FIG. 9, the air passage 12 is a groove formed on an inner wall of the base chamber 11 of the base 1 as shown in the sectional view of FIG. 9.

Figure 10:
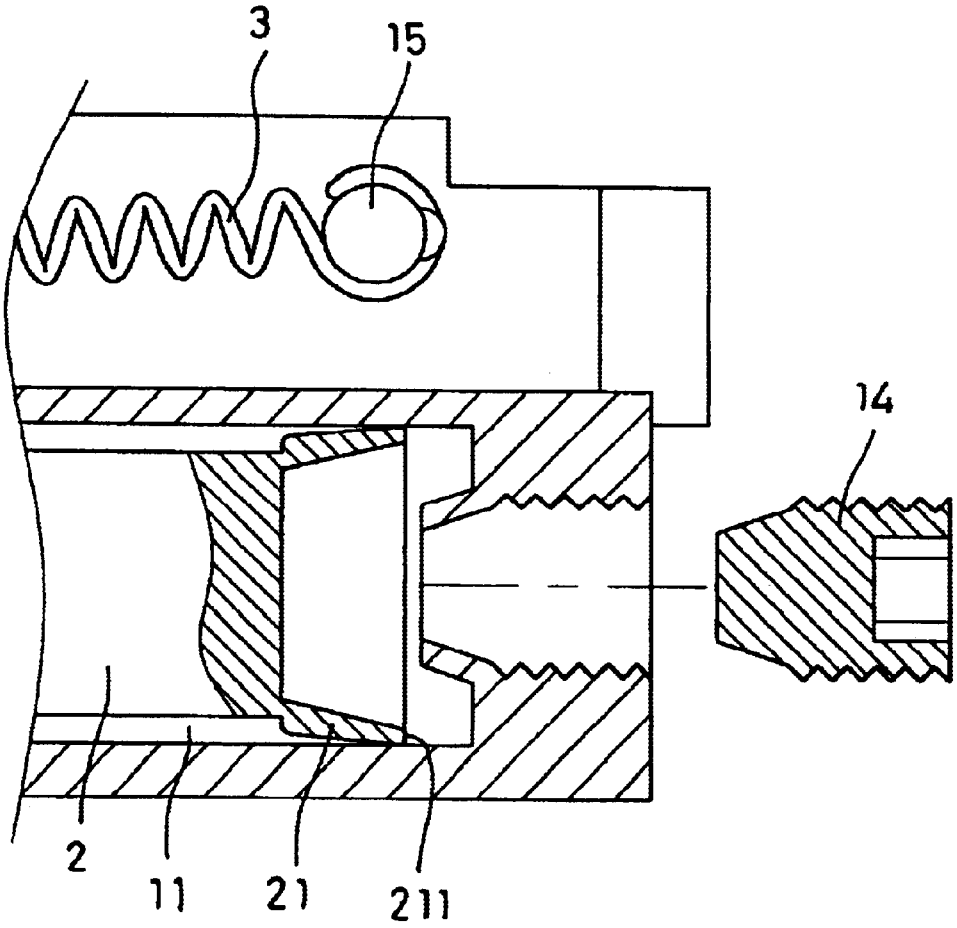
FIG. 10 is a sectional view illustrating a plug type air passage being adopted.

Referring to FIG. 10, the front end of the base 1 has a base plug 14 and the front end has a blind treaded hole for non-tightly engaging with the outer thread screws on the base plug 14 so as to form the air passage 12.

It is appreciated that buffer and return device for a slide rail in a drawer of the present invention allows the drawer with the inner rail thereof to return to the original position slowly when the drawer is pushed inward.

While the invention has been described with reference to the preferred embodiment thereof, it is to be understood that modifications or variations may be easily made without departing from the spirit of this invention, which is defined by the appended claims.

What is claimed is:

1. A buffer and return device for a slide rail of a drawer comprising:

a) a plunger having a plunger head on a first end thereof;

b) a base having:

i) a base chamber located on a first end of the base, the plunger head being slidably inserted into the base chamber;

ii) an air passage located between the plunger and the base chamber; and iii) a lower bend slot located on a second end of the base;

c) a retaining plate having:

i) two spaced apart protruding catches;

ii) a lower projection slidably inserted into the lower bend slot of the base, the plunger and retaining plate being movable between an open and a closed position; and iii) a holding way located between the two spaced apart protruding catches, such that a lock piece of an inner rail of the slide rail is inserted into the holding way and movable between a locked position and a released position;

d) an elastic element connected at a first end to the base and at a second end to the retaining plate, wherein the air passage restricts a flow of air forced out of the base chamber by the plunger when the plunger moves from the opened position to the closed position to reduce a closing speed of the drawer.

2. The buffer and return device according to claim 1, wherein the air passage is a groove formed on an inner wall of the base chamber.

3. The buffer and return device according to claim 1, wherein the elastic element is a spring.

4. The buffer and return device according to claim 1, wherein the base includes an engaging jut, and the elastic element is connected to the engaging jut.

5. The buffer and return device according to claim 1, wherein the retaining plate includes an engaging post, and the elastic element is connected to the engaging post.

6. The buffer and return device according to claim 1, wherein the retaining plate includes a connecting piece, the plunger includes a joining part on a second end thereof, and the joining part is connected to the connecting piece.

7. The buffer and return device according to claim 1, wherein the plunger head includes a plunger ring and a central plunger core, the central plunger core located within the plunger ring, the plunger ring and the central plunger core are spaced apart.

* * * * *